United States Patent [19]

Warkentin et al.

[11] 4,106,628

[45] Aug. 15, 1978

[54] SORTER FOR FRUIT AND THE LIKE

[76] Inventors: Aaron J. Warkentin, 13551 View Dr., Orange Cove, Calif. 93646; George A. Mills, 44 Kaweah River Dr., Three Rivers, Calif. 93271

[21] Appl. No.: 659,898

[22] Filed: Feb. 20, 1976

[51] Int. Cl.[2] ..... B07C 5/28; B07C 5/342

[52] U.S. Cl. ..... 209/74 M; 209/75; 209/111.6; 209/121; 177/145; 356/178; 250/223 R; 250/226

[58] Field of Search ..... 209/74 M, 75, 111.6, 209/121, 73; 250/223 R, 225, 226; 356/178, 186; 177/145, 211

[56] References Cited

U.S. PATENT DOCUMENTS

| | | | |
|---|---|---|---|
| 2,980,252 | 4/1961 | Bray et al. | 209/121 |
| 3,066,797 | 12/1962 | Fraenkel | 250/225 X |
| 3,070,227 | 12/1962 | Larew et al. | 209/75 |
| 3,192,535 | 6/1965 | Watson | 177/211 X |
| 3,206,022 | 9/1965 | Roberts et al. | 209/111.6 X |
| 3,270,880 | 9/1966 | Brian et al. | 209/75 X |
| 3,289,832 | 12/1966 | Ramsay | 209/75 |
| 3,355,015 | 11/1967 | Cervin | 177/145 X |
| 3,651,936 | 3/1972 | Powell | 209/121 X |
| 3,737,236 | 6/1973 | Borrelli | 250/225 X |
| 3,750,883 | 8/1973 | Irving et al. | 209/111.6 |
| 3,773,172 | 11/1973 | McClure et al. | 209/111.6 X |
| 3,901,334 | 8/1975 | Rose | 209/121 X |

*Primary Examiner*—Robert B. Reeves
*Assistant Examiner*—Joseph J. Rolla
*Attorney, Agent, or Firm*—Lyon & Lyon

[57] ABSTRACT

Apparatus for automatically sorting fruit and the like by weight or color, or both, using conveyance system to move objects to be sorted past an electromechanical weighing station and an optical color sensing station which, in conjunction with sequential and combinational logic, compare the color and weight of the item to a predetermined criteria and sort according thereto.

18 Claims, 6 Drawing Figures

-2-
-12-
1
3
4
5
6
7
8
9
10
11
20
22
24
26
28
30
32
34

COLOR SORTER OUTPUTS
128
130
132
134
136
138
140
120
122
124
126
57
112
114
116
118
107
108
109
110
106
104
102
100
PM
PM
50
V+
55
52
54
56
48
V-
46
44
42
38
40
POWER

SORTER FOR FRUIT AND THE LIKE

BACKGROUND OF THE INVENTION

Automated sizing equipment segregate incoming lots into various size categories. Agricultural items such as fruits and vegetables are segregated into various size and color groupings for later packaging, or processing, distribution and eventual sale on the retail level. Such segregation is important since packaged items of a certain "size" may have a different value than a package of a different "size." Additionally, since lot dollar value depends on the item size distribution, growers are paid depending upon the number of items in each category.

Size groupings may be based on number of items per volume—such as number per box, with box weight open—or number per pound—that is, number per box at a fixed weight. Typically, limits are placed on the maximum and minimum variation in fruit size and weight allowable within one box. In addition, where products are packed according to a given number per carton, a minimum weight limit is usually placed on the total carton. In order to account for the fluctuation item size, conventional mechanical sizers must be adjusted to provide for somewhat oversized fruit in order to assure that the minimum poundage per package requirement in met. For example, if 40 pounds per carton is the minimum acceptable weight, it may be that conventional sorting machinery must be set for an average of 41½ pounds to assure that each carton weighs at least 40 pounds. Consequently, a substantial amount of the items are essentially given away.

The reasons for this inaccuracy in conventional weighing systems vary with the type of system. For example, for mechanical sizers using physical dimensions such as diameter, variation could be due to changes in either shape or density within the lot of items to be sorted or from lot to lot. For mechanical spring weighing sizing systems, temperature change, the large number of scales required, vibration, and item positioning may cause inaccurate segregation. With either type system, the inaccuracies inherent in the system itself require that a substantial amount of fruit be given away.

SUMMARY OF THE INVENTION

The present invention relates to automatic sorting devices and, more particularly, to devices for automatically sorting fruit or other goods according to size and/or color.

The present invention uses belt or roller conveyors to receive incoming fruit and channel the fruit into multiple separate, single fruit width, adjacent lanes, the number of lanes being dependent upon machine size. The fruit or other object travels single file on the separate, single fruit width, roller conveyor. On this conveyor the fruit is channeled through a color scanner box where each item is viewed sequentially by an optical detection device for that particular lane. The optical detection device basically averages the color of the two opposite sides of the product and, through associated logic, classifies the object according to color.

The single lane, or singulator, conveyor then conveys the fruit onto a corresponding lane of cups, which are attached to conveyor chains, each cup holding one item. The cups are moved by the conveyor chain over a section of the rail attached to an electronic scale. Each cup with its fruit contents is weighed, and the resulting signal is operated on by logic circuitry to categorize the item of fruit into a predetermined number of categories. The weight category may be combined with the color categories, or used separately, to determine the product's final disposition.

Depending upon the selection criteria programmed into the system, the fruit is carried in the conveyor cup to a series of dropout locations where, depending upon the size and color category determined by the selection criteria, the cup is permitted to tilt. The tilting of the cup discharges the fruit into a predetermined storage or packing location. Typically, the lanes are comprised of cross-conveyors which lead the fruit to various automatic storage or packing means.

A typical sorting system developed according to the present invention may involve five color sorting categories and a dozen or more weight sorting categories. Further, a line printer is provided to determine the number of items being delivered to each category.

Because of the electromechanical weighing of the fruit, the accuracy of the weighing system is increased over conventional weighing systems. Thus, it is possible to decrease the overage necessary in conventional systems, which reduces the amount of fruit given away. Also, because the electromechanical weighing means and associated electronics are less susceptible to temperature, vibration and other effects which inherently decrease the accuracy of conventional systems, the speed with which the present system may operate is increased.

In addition, conventional systems typically have not adequately sorted according to color. The present system, in contrast, accurately sorts according to color and can sort either according to color alone or may incorporate the color criteria into the weight sizing criteria.

It is one object of this invention to provide an improved automatic sorting system which has increased accuracy in weighing of the objects to be sorted.

It is another object of this invention to provide an automatic sizing system which may sort according to color.

It is a further object of this invention to provide an automatic sizing system which operates at increased speed.

Other and further objects and advantages of the present system will be apparent from the following detailed description.

IN THE DRAWINGS

FIG. 1 is a schematic illustration of the automatic sorting system.

FIGS. 2*a* and 2*b* are schematic illustrations of the electronics and logic used to categorize the items to be sorted. FIG. 2*a* illustrates the clocking circuitry and the color sorting circuitry, while FIG. 2*b* illustrates the weight sorting circuitry.

FIGS. 3*a*–3*c* illustrate varying views of the electronic scale mechanism.

DETAILED DESCRIPTION OF THE INVENTION

Figure 1:
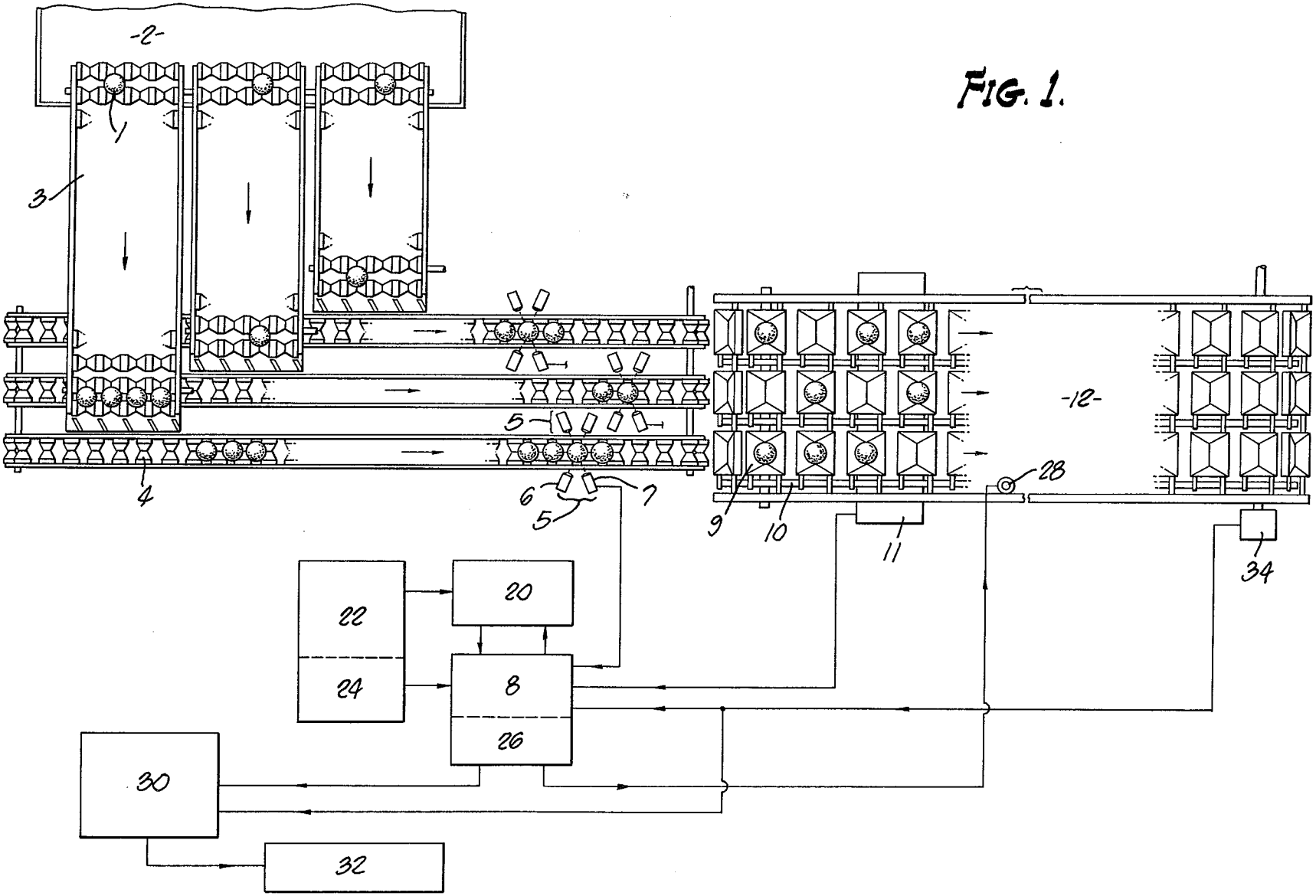

Attention is now directed to FIG. 1, which schematically illustrates the automatic sorting system of the present invention. An item to be sorted 1, typically fruit but not restricted thereto, is delivered from a storage bin 2 onto a series of belt conveyers 3. The belt conveyers 3 align the items to be sorted, such as the item 1, into relative single file arrangements, whereupon the item 1 is conveyed onto a roller conveyer 4. Each belt or roller conveyer 3 feeds a separate roller conveyer 4. Although the number of roller conveyers 4 may vary, a typical application may use three or more lanes of such roller conveyers. Thus, three or more belt or roller conveyers 3 are typically required althouth it is possible to use only a single conveyor 3 to load all of the roller conveyers 4. A suitable conveyance means is similar to that shown in U.S. Pat. Nos. 2,813,617 or 3,017,013.

Once the item 1 has been deposited on the respective roller conveyer 4, the conveyer 4 moves the item 1 past a pair of optical detection devices 5. Each optical detection device consists of a light source 6 and an optical pick-up 7. The light source 6 illuminates the item 1 and the light is reflected onto the optical pick-up 7, which is electrically connected to amplifier and logic circuitry 8. One of the pair of optical protection devices 5 illuminates and detects from one side of the item 1 and the corresponding detection device 5 determines the color of the opposing side of the item 1. Thus, the total signal is derived from a combination of signals from each side of the item 1.

After the conveyer 4 has moved the item 1 past the optical devices 5, the conveyer 4 discharges the item 1 into a cup 9 carried on a conveyer chain 10. The conveyer chain 10 carries the cup 9 containing the item 1 over an electronic scale 11. The cup 9 and its contents are weighed by electronic scale 11, which sends the resulting signal to amplifier and logic circuitry 8. The cup 9 and its contents consisting of item 1 are typically moved several feet by the conveyer chain 10 before being weighed on the electronic scale 11 to minimize any inaccuracies resulting from vibration or mechanical factors.

Once the item 1 has been weighed by the scale 11, the conveyer chain 10 and cup 9 are moved to a series of drop-out locations 12, where the item will be discharged into a particular storage area. Typically, each conveyer chain 10 passes over a dozen or more drop-out locations 12. The present invention has been operated successfully with up to 24 drop-out locations. Each drop-out location represents a different category for size or color variation.

The determination of size and color category is made by amplifier and logic circuitry 8 in conjunction with manually preset inputs from weight and count adjust circuitry 20 as well as weight and color control circuitry 22 and drop-out location control 24. On the basis of these inputs and the data received from the optical detection devices 5 and the electronic scale 11, amplifier and logic circuitry 8 signals a particular relay in a set of relays 26, which activates particular drop-out solenoid 28. The drop-out solenoids 28 are located in the series of drop-out locations 12, and when activated permit the cup 9 to tilt about the conveyer chain 10, thereby discharging the item 1 into the appropriate sorting location. At the same time, amplifier and logic circuitry 8 feeds a printer interface 30, which consists of counting and storage logic for providing an input to printer 32. Printer 32 provides a record of the number of items sorted into each category.

A shaft encoder 34 is provided at the end of the drop-out locations 12 and is operated by the conveyor chain 10. As each cup 9 carried by the conveyer chain 10 passes the shaft encoder 34, the encoder 34 generates a clocking signal to amplifier and logic circuitry 8, thereby synchronizing the mechanical movement of the item 1 with the electronic positioning of that item.

Referring again to the optical detection devices 5 which are usually housed in a cover (not shown) to avoid ambient light reflection, the light source 6 may consist of a conventional light bulb, for example, a 3.5 volt DC incandescent bulb, with a focusing lens and a polarizing filter to illuminate an area of the item 1, typically a circle about three inches in diameter. The optical pick-up device 7 typically consists of a polarizing filter (to cut reflective glare) placed in front of a fiber optic light pipe (not shown). By orienting the direction of the polarizing filter on the light source 6 perpendicular to that on the photo 1 pick-up device 7, light from the light source 6 cannot directly enter the pick-up 7. This permits accurate segregation at low light levels. Because the color sorter preferably operates on the two-color theory, which categorizes objects according to how much of each of two colors is found in the object, the fiber bundle (not shown) is typically divided into two halves. The light passing through each half is transmitted through a filter (not shown) a predetermined color (each of the two filters typically having a different color) and thence into an electrically photosensitive device (not shown) preferably a photomultiplier tube although a photodiode is acceptable for many applications. For the sorting of apples, one filter may be green and the other dark red. The two photomultiplier tubes produce a signal proportional to the amount of each color transmitted by the respective filter as found in the item 1. The two signals generated thereby are combined with the signals generated by the other pick-up device 7 in the pair of optical detection devices 5. As noted previously, the four signals generated by the two pick-up devices 7 are then transmitted to the amplifier and logic circuitry 8 where the item 1 is categorized by color according to a predetermined criteria, as discussed hereinafter.

Figure 2A:
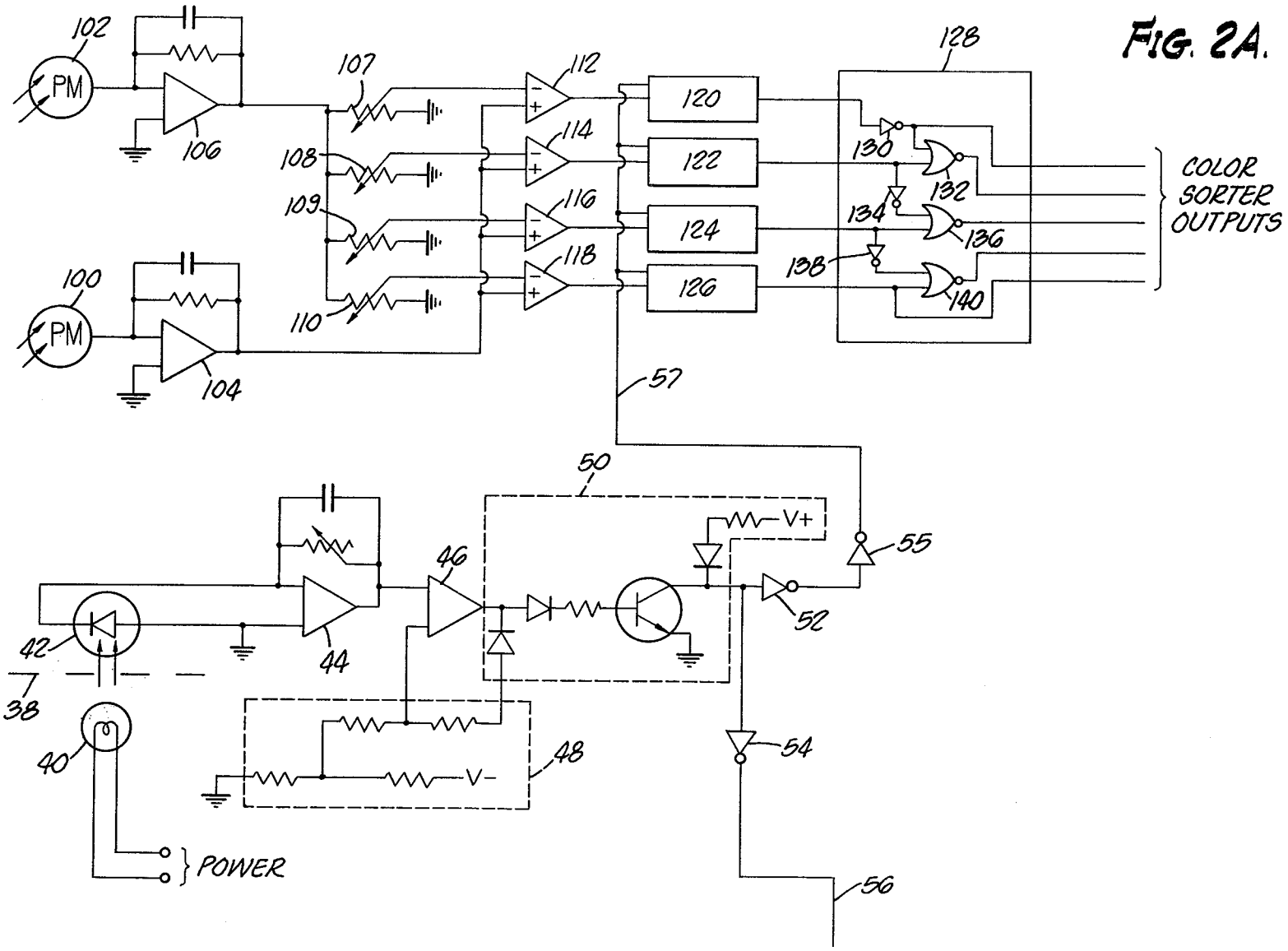
Figure 2B:
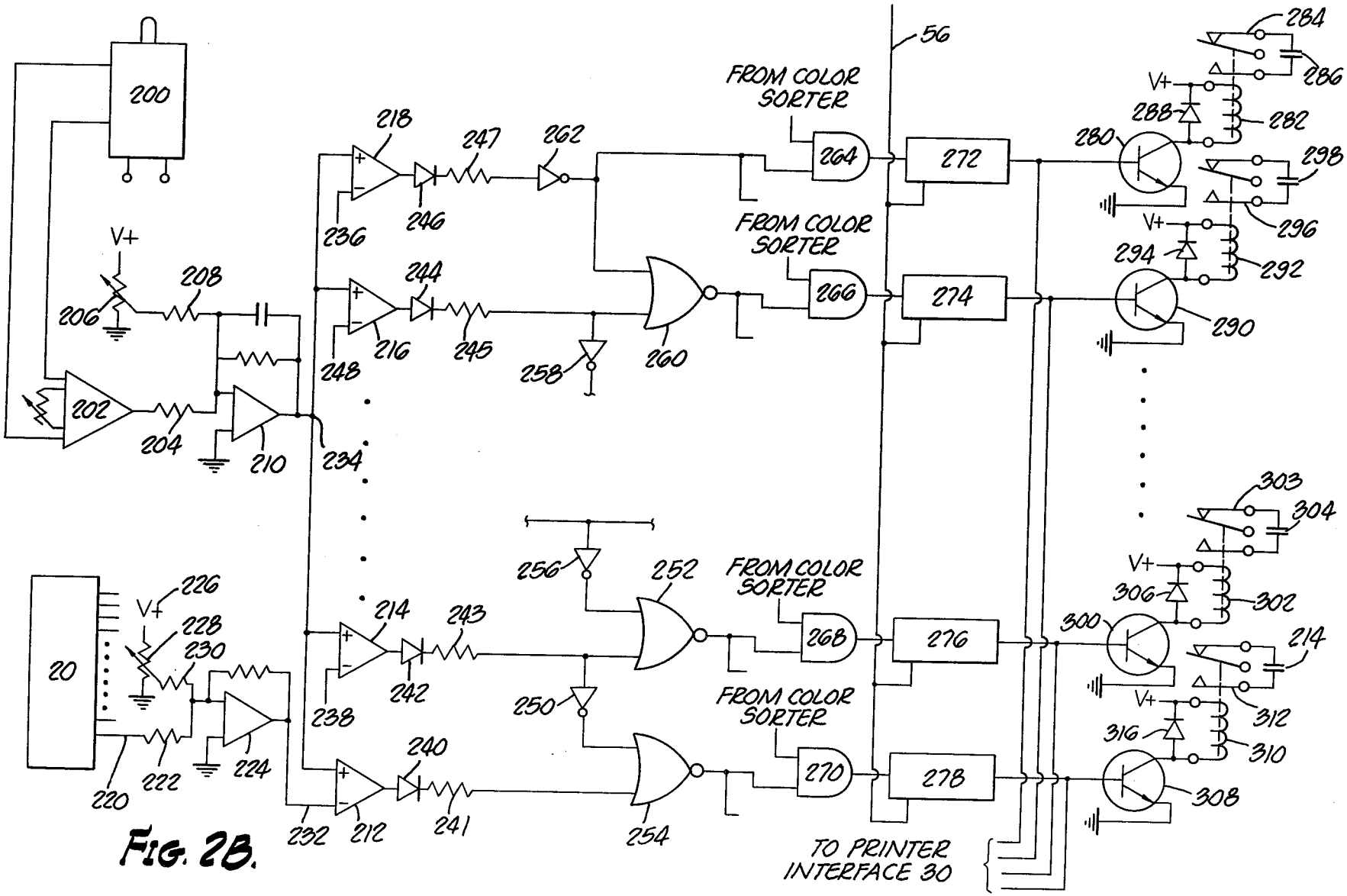

Attention is now directed to FIGS. 2*a* and 2*b*, which illustrate adequately the electronics of the amplifier and logic circuitry 8, relays 26 and the weight and count adjust circuitry 20. Referring to FIG. 2*a*, slotted disc 38 is connected to shaft encoder 34 (FIG. 1), such that with each movement of the shaft encoder 34 a slot on the disc 38 permits a lamp 40 to illuminate a photodiode 42. The photodiode 42 is connected across the inputs of an op amp and associated biasing circuitry 44 to amplify the signal from the photodiode 42. The output of the op amp 44 is fed into a comparator 46. Comparator 46 and biasing circuitry 48 provide high and low logic levels suitable for performing logic functions. An inverter 50 performs level shifting and inversion functions and generates a signal suitable for use with conventional digital logic devices. The signal generated by the inverter 50 is again inverted by inverters 52, which supplies a clocking signal 56 to the weight sorting circuitry shown in FIG. 2*b*, and inverters 54 and 55, which supply a clocking signal 57 to the color sorting circuitry discussed below. It can be seen that the clock signals 56 and 57 are generated by the shaft encoder 34, and that the shaft encoder is operated by the conveyer chain 10. It will be remembered that conveyer chain 10 carries the cup 9 containing the item 1 to be sorted. Thus, the clock signal 56 is in synchronization with the movement of the item 1. An alternative to the lamp 40 and photodiode 42, a magnetically actuated mercury switch may be used.

As previously discussed in connection with FIG. 1, the light source 6 from each side of the item 1 illuminates, through a focusing lens and a polarizing filter, an area typically about 3 inches in diameter that side of the item 1. The reflected light passes into the polarizing filter, focusing lens and fiber optic bundles comprising the optical pick-up 6 from each of the pair of optical detection devices 5. As further previously described, the fiber optic bundles from each pick-up 7 are split into halves; one half of the bundle from each pick-up 7 is combined with one half of the bundle from the opposing pick-up 7, thereby effectively summing the light from one side of the item 1 with that from the other side of the item. The light transmitted through the combined bundle is then passed through a first color filter (example, dark red) and into a photomultiplier tube 100, shown in FIG. 2*a*. The remaining halves of the fiber optic bundles are similarly combined, and the light transmitted therethrough is passed through a filter of a second color (example, green) and thence into a second photomultiplier tube 102.

The output of the photomultiplier 100 is then fed into op amp (and associated biasing circuitry) 104 and the output of photomultiplier 102 is fed into op amp 106, where the signals are amplified. The output of op amp 104 is then fed into one input of a series of comparators, for purposes of example comparators 112, 114, 116 and 118. The remaining input to the comparators 112, 114, 116 and 118 is derived from the output of op amp 106 by passing the output through a voltage divider comprised of a variable resistor with one terminal grounded. Thus the second input of the comparator 112 is the output of op amp 106 passed through variable resistor 107, the output of op amp 106 is passed through variable resistor 108 to provide the second input to comparator 114, the output of op amp 106 is passed through resistor 109 to comparator 116, and through resistor 110 to comparator 118.

By varying the position of the slide on variable resistors 107, 108, 109 and 110, the respective comparators 112, 114, 116 and 118 generate outputs proportional to a range of colors of the item 1. For example, assume a green filter is placed between the fiber optic bundle and photomultiplier 102, and a red filter between the fiber optic bundle and photomultiplier 100 (the lighter colored filter is usually used in the channel having the variable resistors), and variable resistors 107, 108, 109 and 110 are set to provide decreasing resistance. Then, a light green apple will cause a large magnitude signal from op amp 106 and a much smaller signal from op amp 104. Thus, the output of all comparators 112, 114, 116 and 118 may be a low level, or "zero." Conversely, a very dark red apple may cause a much larger signal from op amp 104 than op amp 106, in which case, depending on the setting of the variable resistors 107, 108, 109 and 110, the comparators 112, 114, 116, and 118 may have a high level ("one") output. Varying shades of red may cause a series of combinations of outputs from the comparators, although those skilled in the art will recognize that only five classifications by color are possible with only four comparators. Clearly, more classifications are possible merely by adding more variable resistors and comparators. Thus, it can be seen that the use of two signals with variable resistors and comparators will permit automatic categorizing of the item 1 by color.

To synchronize the color information derived from the comparators 112, 114, 116 and 118, the outputs of the comparators 112, 114, 116 and 118 are clocked into shift registers 120, 122, 124 and 126, respectively, by the clocking signal 57 developed from the shaft encoder 34. The shift registers 120, 122, 124 and 126 are typically of CMOS construction to avoid voltage level shifting problems, and clock on the negative clock transition, although those skilled in the art will recognize that many obvious variations exist without departure from the spirit of the invention disclosed herein. The shift registers 120, 122, 124 and 126 synchronize the color data of the item 1 with its position while the item 1 is moving from the optical detection devices 5 to the electronic scale 11 (FIG. 1); the size of the particular shift register thus depends on the distance from the detection device 5 to the scale 11. As will also be recognized by those skilled in the art, the present invention could really be configured to permit weighing the item 1 in scale 11 before categorizing the item 1 by color.

When the item 1 has reached the electronic scale 11, the color data associated with that item will be clocked onto the outputs of the shift registers 120, 122, 124 and 126. The outputs are then fed into logic network 128 to complete the color sorting of the item 1.

A logic network 128 is arranged to provide five categories of color sorting, with a high signal appearing only on the output which corresponds to the proper color category of the item 1. Thus, as shown in FIG. 2*a*, the output of shift register 120 feeds inverter 130. Inverter 130 in turn feeds an output of the logic network 128 and one input of a two-input nor gate 132. The remaining input of the nor gate 132 is supplied by the output of shift register 122, which output also feeds an inverter 134. The output of the nor gate 132 provides a second output of the logic network 128. The inverter 134 supplies one input of a two input nor gate 136, the other input of which is supplied by the shift register 124 and the output of which supplies a third output of the logic network 128. The output of the shift register 124 also supplies an input to an inverter 138, which in turn provides one input to a fourth two input nor gate 140, the output of which supplies the fourth output of the logic network 128. The remaining input of the nor gate 140 is provided by the shift register 126 which also provides a fifth output of the network 128. Should additional color sorting channels be desired, the necessary shift registers and logic circuitry would be analogous to those described herein.

To illustrate the operation of the logic network 128, let it be assumed that a very light green apple causes a "zero" on the output of all four comparators, while a very dark red apple causes a "one" on all four comparator outputs. Then, assuming that item 1 is a very light green apple, the outputs of a four comparators 112, 114, 116 and 118 are low and, after the proper clocking delay, the outputs of all four shift registers will be low. Then the output of inverter 130 will be high while the output of the nor gates 132, 136 and 140, as well as the output of the shift register 126, will all be low. Conversely, if the item 1 is a dark red apple, the outputs of all four shift registers will be high, in which case the output of shift register 126 is high and the outputs of nor gates 132, 136 and 140 and inverter 130 are all low. The remaining combinations and corresponding outputs follow analogously. Thus, the logic network provides a single high output which corresponds to the color category of the item 1. As will be discussed in connection with FIG. 2*b*, the color sorter outputs of the logic network 128 are combined with the weight category of the item 1 to determine the final drop-out location.

Attention is now directed to FIG. 2*b*, which schematically illustrates the weighing circuit and associated logic for determining the weight and color category into which the item 1 should be placed. With reference to FIG. 1, when the cup 9 containing the item 1 to be weighed passes the electronic scale 11, the cup 9 and its contents cause a force on transducer 200, typically a strain gauge, which generates a signal in proportion to the weight of the item 1 (neglecting the weight of the cup 9). A transducer suitable for use with the present invention is the Statham Linear Displacement Accessory, Model UD3. The signal generated by the transducer 200 is fed into a comparator 202 which generates a positive or negative signal. The output of the comparator 2 is then fed through a resistor 204 and summed with a reference voltage generated by variable resistor 206 and resistor 208 in conjunction with a positive voltage source. The sum of the voltages then feeds the input of an op amp and associated feedback network 210. The signal generated by the op amp 210 is thus seen to be proportional to the weight of the item 1. The output of the op amp 210 is then fed into a series of comparators, the exact number of which is arbitrary and limited only by the number of dropout locations which the user prefers to employ. For purposes of the present example, it will be assumed that there are twelve comparators into which the signal from the op amp 210 is fed as one imput. Thus it can be seen that the signal is fed into comparators 212, 214, 216 and 218. It will be noted that only four comparators of the 12 are shown since the omitted comparators and associated logic circuitry are analogous to those shown. The remaining imput to the comparators 212 through 218 is a reference voltage set by the weight and count adjust circuitry 20.

Weight and count adjust circuitry 20 may be suitable circuitry for generating a series of incremental reference voltages which are adjustable according to the range of weights of the item to be sorted. That is, assuming that 12 weight categories are desired, weight and count adjust circuitry 20 provides 12 reference voltages, each of which indicates one reference category. However, since the present invention is intended to be used to sort items which may vary broadly over a range of weights, weight and count adjust circuitry 20 must be able to be adjusted to provide a varying range of incremental reference voltages. For example, weight and count adjust circuitry may comprise merely a series of resistive elements connected to a single reference voltage, or adjust circuitry 20 may comprise multiple voltages variable through more complex or sophisticated logic circuitry. Further, the number of weight categories into which the item 1 may be sorted is arbitrary and thus the weight and count adjust circuitry may be required to have any number of reference voltage outputs.

The first voltage output 220 of adjust circuitry 20 is fed through a resistor 222 and summed at the inut of op amp and associated feedback loop 224 with a reference voltage derived from voltage source 226, variable resistor 228 and resistor 230. The output of op amp 224 is then fed into the first comparator 212. Only the circuitry for generating a first reference voltage as applied to comparator 212 is shown since the circuitry for generating reference voltages 2 through 12 for input into comparators 214 through 218, respectively, is identical. The only difference will be the reference voltage supplied by weight and count adjust circuitry 220. At this point, a first reference voltage 232 is applied to the input of the comparator 212 and a voltage 234 which is proportional to the weight of the item 1 as determined by the electronic scale 11 is supplied to the other input of comparator 212. Depending upon the magnitude of the voltage signal 234, and the reference voltage 232, the output of comparator 212 either goes to a high level or a low level.

Let it further be assumed, for purposes of example, that the reference voltage 232 indicates the maximum weight category into which the item 1 may be sorted, and that the reference voltages incrementally decrease until the twelfth reference voltage 236 supplied to comparator 218 indicates the minimum weight category into which the item 1 may be sorted. Thus, the item 1 is sorted into the category indicated by reference voltage 236 only if the voltage signal 234 is less than the reference voltage 236. It will be noted that if there are only twelve categories into which the item 1 may be sorted, the reference voltage 232 must be set for a magnitude greater than the maximum which voltage signal 234 may achieve. Thus the maximum weight category indicated by the output of comparator 212 consists of those items which fall between the reference voltage 238 supplied to comparator 214 and reference voltage 232 supplied to comparator 212. In this event, the output of comparator 212 is always low.

For purposes of example, let is be assumed that the weight of the item 1 is sufficient to cause the voltage signal 234 to fall between the reference voltages 239 and 232. In this event, the output of comparator 214 will be high while the output of comparator 212 will be low. The output of comparator 212 is then fed through a diode 240 and resistor 241 to provide level shifting and current stabilization. Because the logic circuitry preferably employed is CMOS technology, level shifting circuits are not greatly needed. Similarly, the output of the comparator 214 is passed through a diode 242 and resistor 243. Similarly, the output of the comparator 216 feeds a diode 244, which in turn feeds a resistor 245, and the comparator 218 feeds a diode 246 which in turn feeds a resistor 247.

The signals passing through the resistors 241, 243, 245 and 247 are then fed into a logic network analogous to the logic network 128 used in the color sorting circuit shown in FIG. 2*a*. That is, the signal from the comparator 212 is fed into one input of a two input nor gate 254, the other input of which is fed by an inverter 250 which is controlled by the signal from the comparator 214. The signal from the comparator 214 also feeds one input of a two input nor gate 252. The remaining input of the nor gate 252 is provided by an inverter 256, which is controlled by one of omitted comparators. The inverter 256 may be analogized to an inverter 258. The inverter 258 is controlled by the signal from the comparator 216, which also supplied one input to a two input nor gate 260. The remaining input to the nor gate 260 is supplied by an inverter 262, analogous to the inverter 130 in the logic network 128 (FIG. 2*a*), which is controlled by the comparator 218. Thus, 12 weight categories are provided by the twelve comparators, and associated inverters and nor gates. By analogy to the shift register 126, a thirteenth weight category may be provided by use of a signal directly from the comparator 212.

The outputs of the inverter 262 and the nor gates 252, 254, 260, and those omitted, thus provide a single high output, the remaining outputs being low, and the high output indicates the weight category of the item 1. The outputs of the inverter 262 and the nor gates 252, 254 and 260 are combined with signals from the color sorter outputs of the logic network 128, shown in FIG. 2*a*, by "and"ing the weight signal with the color signal in and gates 264, 268, 270 and 266, respectively, to determine the ultimate category into which the item 1 will be sorted. It should be noted that the present example provides five color categories and twelve weight categories, or a total of sixty possible categories into which an item 1 might be sorted. Since a typical application may use only 24, or less, categories, many applications ignore possible categories. Thus, the user typically choses the interrelationship of color and weight categories suitable for his application. Thus, one of the inputs to the and gates 264, 266, 268 and 270 is shown as merely from the color sorter outputs of the logic network 128.

Since only one weight category provides a high output, and only one color category provides a high output, only one of the and gates 264, 266, 268 and 270 will provide a high output, and all others will provide a low output. The outputs of the an gates 264, 266, 268 and 270 are then clocked into a series of shift registers 272, 274, 276 and 278, respectively, by a clocking signal 56 provided by the shaft encoder 34, which also provides the clocking signal 57 to the color sort circuit shown in FIG. 2*a*. Thus, the shift registers 272, 274, 276 and 278 indicate the position of the item 1 after it passes from the electronic scale 11 into the dropout locations 12 (FIG. 1). The size (number of bits) of the shift registers 272, 274, 276 and 278 varies depending upon the total number of dropout locations, and upon the desired dropout location for a particular category.

For example, it may be that the dark red, heaviest apples should be dropped out at the first location, while the smallest light green apples should be dropped out at the sixtieth location. In such event, the shift register associated with the heaviest dark red apple will be only one bit, while the shift register associated with the small green apples will provide sixty bits of storage. This permits automatic sorting in the following manner. When the high logic level associated with the Item 1 appears at the output of its respective shift registers, for example the shift register 272, that logic level saturates a driver transistor 280. The collector of the transistor 280 is connected to one terminal of the coil of a reed relay 282, the other terminal of which is connected to a positive supply voltage. The associated relay contacts 284 close when the transistor 280 saturates, thus causing a dropout solenoid 28 (FIG. 1) to energize, which pulls back a portion of the track on which the cup 9 (FIG. 1) rides, thereby allowing the cup 8 to tilt discharging the Item 1 into the proper location. Transient protection is provided by capacitor 286 across the terminals of relay contacts 284 and by diode 288 across the terminals of relay coil 282. The remaining shift registers, all of varying size to permit sorting at varying locations, are similarly associated with driver transistors and relays. Thus, shift register 274 controls a dropout location through transistor 290, coil 292, contacts 296, capacitor 298 and diode 294. The shift register 276 controls a dropout location through a transistor 300, the coil 302, contacts 303, capacitor 304 and diode 306, while shift register 278 is similarly connected to transistor 308, coil 310, contacts 312, capacitor 314 and diode 316.

As will be recognized by those skilled in the art, the dropout location for a particular category may be altered by changing which and gate supplies an input to a particular shift register. Thus, a patch cord board may be provided to soft wire the and gate output to the desired shift registers, just as a patch cord board may be provided to let the user associate a particular weight category with a particular color category. Further, switch means may be provided at the inputs to the and gates to block the weight category inputs, thus permitting the use of only the color sort circuitry, or to block the color category inputs and thus sort only by weight.

Also provided is a printer interface 30 and printer 32, which have inputs supplied by the outputs of the shift registers 272, 274, 276 and 278. The printer interface provides a random access memory and accounting logic which permits the printer 32 to print out, when activated, the number of items of each category during a period of sorting. This permits a running tally of the number of items in each category to be automatically maintained, thereby easing accounting problems.

Figure 3A:
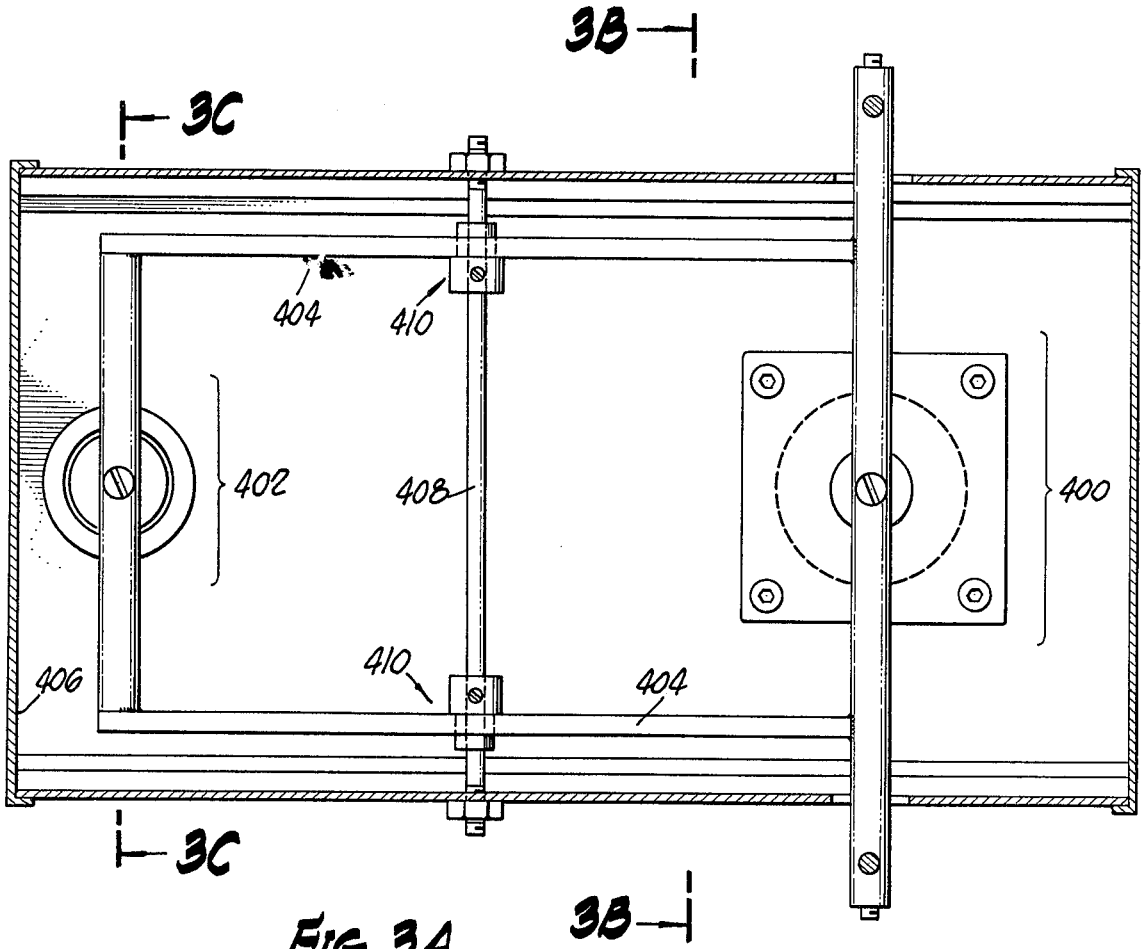
Figure 3C:
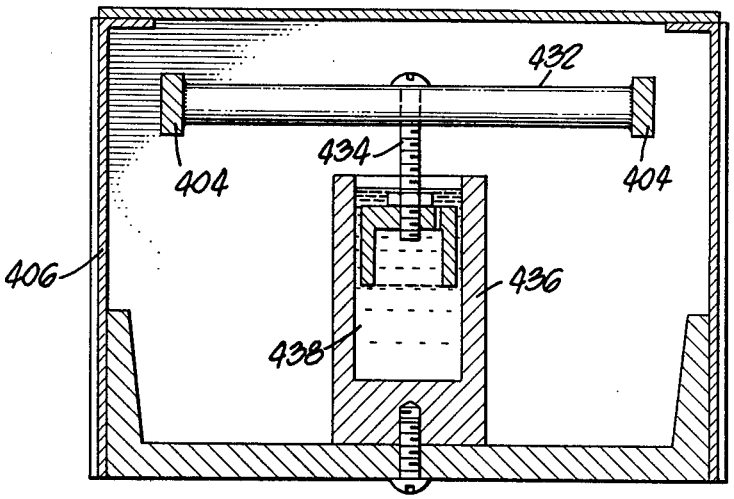
Figure 3B:
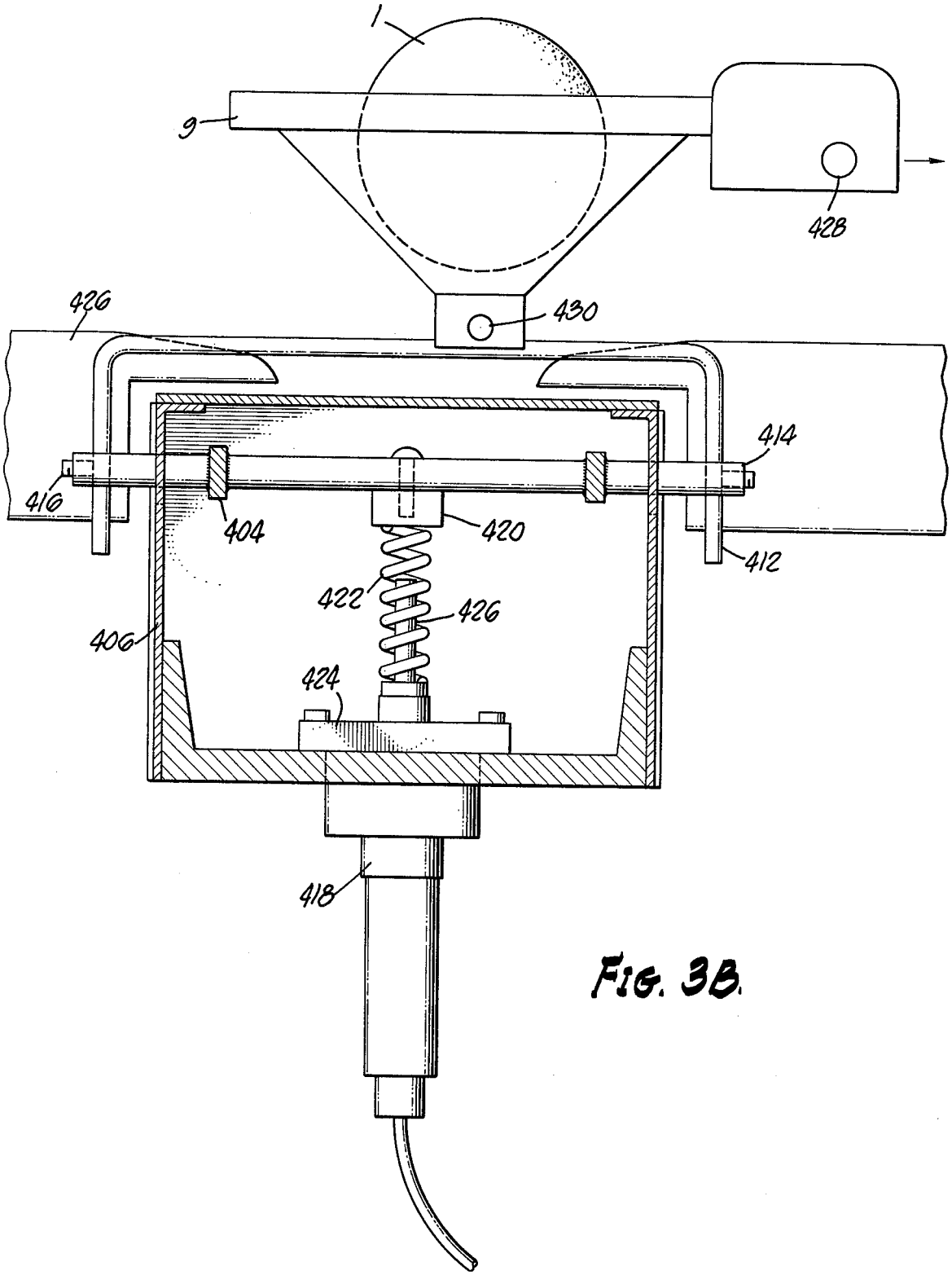

Attention is now directed to FIGS. 3*a*–3*c*, which illustrate the electronic scale 11 in greater detail. Referring to FIG. 3*a*, it can be seen that the electronic scale 11 comprises a weigher section 400, discussed in connection with FIG. 3*b*, and a damping section 402, discussed in connection with FIG. 3*c*, connected by a pair of scale arms 404 and supported and enclosed within a housing 406. The scale arms 404 pivot about a pivot shaft 408 through needle bearings 410. The needle bearings 410 are positioned by a set screw or other means on the pivot shaft 408 so as to prevent lateral movement of scale arms 404 along the shaft 408. The shaft 408 is further supported by the housing 406.

Referring to FIG. 3*b*, the weigher section 400, over which the cup 9 and its contents pass, is comprised of a scale runner 412 connected to a weigher arm 414 by means of screws 416. Slots are provided in the scale runner 412 so that the height of the scale runner 412 may be adjusted. The weight of the cup 9 - item 1 combination is transferred to the strain gauge 200 (as shown in FIG. 2*b*) mounted directly below the center of the scale runner 412, through rubber pad 420, compression spring 422 and strain gauge force adaptor 424. The compression spring 422 is held in position by the spring guide shaft 426 which screws directly into the adaptor 424. Vertical movement of the weigher arm 414 is permitted by slots in the housing 406. The rubber pad 420 mounts on the weigher arm 414 and directly contacts the spring 422.

To avoid excessive vibration of the cup 9 as it moves onto the scale runner 412, a micarta rail 426 or other rail with a low coefficient of friction is beveled to provide a smooth transition from the rail 426 onto the runner 412. The cup 9 is drawn along the rail by the conveyor chain 10, discussed in connection with FIG. 1. The cup 9 is connected to the conveyor chain 10 by means of a pivot cross rod, and is maintained in a horizontal position by a supporting cross rod 430 which rests on a track of which the micarta rail 426 is a part. During weighing the supporting cross rod 430 rests on the scale runner 412, located at a break in the micarta rail 426. By using a scale runner 412 which extends across the entire break in the rail 426 and is connected to the weigher arm 414 at both sides of the housing 406, the weight of the cup 9 - item 1 combination may be taken at any time while the cup 9 is over the scale runner 412. However, to minimize any vibration which may result from the transition between the rail 426 and scale runner 412, the weight is preferably taken just before the cup 9 exits the scale runner 412.

To avoid erroneous signals from the strain gauge 200 and thereby to permit accurate weighing of the cup 9 and its contents in 1/10 of a second or less with cups traveling 3 feet per second, the damping section 402 shown generally in FIG. 3*a* and in greater detail in FIG. 3*c* is provided. The damping section 402 comprises a damping arm 432 connected between the pair of scale arms 404 and connected at its center to a dashpot plunger 434. The dashpot plunger 434 protrudes into a damper body 436 filled with a damping fluid 438. The damper body is mounted on the housing 406 by a screw or other means. By adjusting the visosity of the damping fluid and the compliance of the compression spring 422 (FIG. 3*b*), the signal transmitted by the strain gauge 200 (FIG. 3*b*) will have a minimum of bounce, or overshoot and undershoot, in a minimum time period. Silicon damping fluid has been found suitable for some applications although the fluid viscosity and compliance of the spring 422 will vary depending on the range of weights of the item 1. Accuracy within ±2% has been achieved in 1/10 second or less using round weighted balls in a cup traveling 3 feet per second.

Thus it can be seen that the invention disclosed herein provides an improved apparatus for automatically sorting items such as fruit and the like according to color, weight, or both.

Having fully described the invention it is to be understood that it is not to be limited to the details herein set forth, but that the invention is of the full scope of the appended claims.

We claim:

1. An automatic sorting apparatus comprising conveyance means for transporting a plurality of items to be sorted along a track and having individual cups for transporting each said item, said individual cups being connected in a continuous belt, electronic weighing means incorporated into a portion of said track for generating a signal proportional to the weight of said item to be sorted, reference signal means for providing a predetermined number of reference signals, the value of each signal established according to a predetermined criteria, comparison means for comparing the signal generated by said electronic weighing means to the reference signals provided by said reference signal means, clock means for incrementally signalling changes in position of an item to be sorted, first position indicating means responsive to the signal from said clock means and the signal from said comparison means for generating a signal indicative of the position of the item to be sorted, and discharge means responsive to the signal generated by said position indicating means for discharging the item to be sorted at a predetermined position.

2. The apparatus of claim 1 wherein said electronic weighing means comprises a strain guage.

3. An automatic sorting apparatus comprising optical detection means for generating at least two reflectance signals, each proportional to the color of an item to be sorted, but responsive to different wavelengths of reflected light, reference signal means for providing a predetermined number of reference signals, the value of each signal being established according to a predetermined criteria, said reference signal means having an input provided by the first of said two reflectance signals, comparison means for comparing the second of said two reflectance signals generated by said optical detection means to the reference signals provided by the said reference signals means for generating a signal therefrom, clock means for incrementally signaling changes in position of an item to be sorted, and first position indicating means responsive to the signal from said clock means and the signal from said comparison means for generating a signal indicative of the position of an item to be sorted.

4. The apparatus of claim 3 further comprising:

discharge means responsive to the signal generated by said position indicating means and said clock means for discharging the item to be sorted at a predetermined position.

5. The apparatus of claim 3 wherein said optical detection means comprises light source means for iluminating an area of an object to be sorted; and optical pickup means sensitive to light reflected from the object to be sorted, said light source means and said optical pickup means being relatively positioned so that light from said light source means is reflected from the item to be sorted into said pickup means.

6. The apparatus of claim 5 wherein said optical pickup means further comprises a polarizing filter.

7. The apparatus of claim 6 wherein said light source means further comprises a polarizing filter positioned so as to prevent stray light from said light source means from entering said pickup means.

8. The apparatus of claim 7 wherein said light source means and said optical pickup means each further include a focusing lens.

9. The apparatus of claim 7 wherein said optical pickup means further includes fiber optic means for relaying light reflected from the item to be sorted to a light sensing means for detecting variations in the magnitude of the reflected light.

10. An automatic sorting apparatus comprising electronic weighing means for generating a signal proportional to the weight of an item to be sorted, first reference signal means for providing a predetermined number of reference signals, the value of each signal being established according to a predetermined criteria, first comparison means for comparing the signal generated by said electronic weighing means to the reference signals provided by said first reference signals means, optical detection means for generating a signal proportional to the color of an item to be sorted, second reference signal means for providing a predetermined number of reference signals, the value of each signal being established according to a predetermined criteria, second comparison means for comparing the signal generated by said optical detection means to the reference signals provided by said second reference signals means, and generating a signal therefrom, clock means for incrementally signaling changes in the position of the item to be sorted, first position indicating means responsive to a signal from said clock means and said signal from said second comparison means for continuously indicating the position of an item to be sorted while the item is in transit between said optical detection means and said electronic weighing means, second position indicating means responsive to the signal from said clock means, the signal from said first comparison means and said first position indicating means for generating a signal continuously indicative of the position of an item to be sorted after said item has been weighed, and discharge means responsive to the signal from said second position indicating means for discharging the item at a predetermined one of a plurality of sorting positions.

11. The apparatus of claim 10 wherein said optical detection means comprises a polarized light source means and a polarized optical pickup means, the polarization of the light source means being arranged relative to the polarization of the optical pickup means such that no light from said light source means may be reflected directly into said optical pickup means, said light source means and said pickup means being mutually positioned relative to an item to be sorted such that light from said light source means is reflected by the item to be sorted into said optical pickup means.

12. The apparatus of claim 11 wherein said optical pickup means further includes fiber optic means for relaying light to optical sensing means for detecting the magnitude of the reflected light.

13. The apparatus of claim 12 wherein said fiber optic means relays light reflected from the item to be sorted through a filter of a first color into one of said optical sensing means, and through a filter of a second color into a second of said optical sensing means, the magnitude of the signal received by the first of said optical sensing means being compared with the magnitude of the signal received by the second of said optical sensing means according to a predetermined criteria to sort an item into one of a range of color categories.

14. An automatic sorting apparatus comprising optical detection means for generating at least two signals, the first of said signals being proportional to the reflectance of an item to be sorted at a first frequency, and the second of said signals being proportional to the reflectance of said item at an second frequency, reference signal means for providing a predetermined number of reference signals, the value of each reference signal being established according to a predetermined criteria and said reference signal means having an input provided by said first signal generated by said optical detection means, and comparison means for comparing the second signal generated by said optical detection means to the reference signals provided by said reference signal means and generating a signal therefrom.

15. The apparatus of claim 14 wherein said optical detection means comprises light source means for illuminating an area of said item to be sorted, and optical pickup means sensitive to light reflected from said object to be sorted, said light source means and said optical pickup means being relatively positioned so that light from said light source means is reflected from said item into said pickup means.

16. The apparatus of claim 15 wherein said optical pickup means further comprises a polarizing filter.

17. An automatic sorting apparatus comprising conveyance means for transporting an item to be sorted along a track and having individual cups for transporting each said item, electronic weighing means incorporated into a portion of said track for generating a signal proportional to the weight of said item to be sorted, said electronic weighing means comprising a transducer means connected to a first member through a spring, a damping means connected to a second member for decreasing the overshoot of said transducer means in response to a force from the item to be sorted, said damping means being connected to said transducer means by a pair of members connecting said first and second member, and said pair of members being pivotally supported, reference signal means for providing a predetermined number of reference signals, the value of each signal being established according to a predetermined criteria, comparison means for comparing the signal generated by said electronic weighing means to the reference signals provided by said reference signal means, clock means for incrementally signaling changes in position of the item to be sorted, first position indicating means responsive to the signal from said clock means and the signal from said comparison means for generating a signal indicative of the position of the item to be sorted, and discharge means responsive to the signal generated by said position indicating means for discharging the item to be sorted at a predetermined position.

18. An automatic sorting apparatus comprising electronic weighing means for generating a signal proportional to the weight of an item to be sorted, first reference signal means for providing a predetermined number of reference signals, the value of each signal being established according to a predetermined criteria, first comparison means for comparing the signal generated by said electronic weighing means to the reference signals provided by said first reference signal means, and generating a signal therefrom, optical detection means for generating a signal proportional to the color of an item to be sorted, second reference signal means for providing a predetermined number of reference signals, the value of each signal being established according to a predetermined criteria, second comparison means for comparing the signal generated by said optical detection means to the signals provided by said second reference signal means, and generating a signal therefrom, clock means for incrementally signalling changes in position of the item to be sorted, first position indicating means responsive to a signal from said clock means and the signal from a first one of said first and second comparison means for generating a signal continuously indicative of the position of an item to be sorted while the item is in transit between a first one of said optical detection means or said electronic weighing means, and the other of said optical detection means or said electronic weighing means, second position indicating means responsive to the signal from said clock means, the signal from said first position indicating means, and the signal from the other of said first and second comparison means for generating a signal continuously indicative of the position of the item to be sorted after the item has passed the other of said optical detection means and said electronic weighing means, and discharge means responsive to the signal from said second position indicating means for discharging the item at a predetermined one of a plurality of sorting positions.

* * * * *